US005873393A

United States Patent [19]

Kordt

[11] Patent Number: 5,873,393

[45] Date of Patent: Feb. 23, 1999

[54] DEVICE FOR FILLING A CONTAINER WITH FREE-FLOWING BULK MATERIAL

[75] Inventor: Hans Kordt, Bloomingdale, Ill.

[73] Assignee: Waeschle Inc., Houston, Tex.

[21] Appl. No.: 966,129

[22] Filed: Nov. 7, 1997

[51] Int. Cl.[6] ..... B65B 1/06

[52] U.S. Cl. ..... 141/67; 141/286; 239/524; 239/654

[58] Field of Search ..... 141/67, 286; 239/654, 239/650, 524

[56] References Cited

U.S. PATENT DOCUMENTS

| | | | |
|---|---|---|---|
| 3,527,413 | 9/1970 | Crowther . | |
| 3,601,955 | 8/1971 | Ferri . | |
| 3,677,311 | 7/1972 | Parrish . | |
| 4,083,607 | 4/1978 | Mott . | |
| 4,284,359 | 8/1981 | Rapolla . | |
| 4,419,790 | 12/1983 | Niedecker . | |
| 4,586,549 | 5/1986 | White | 141/67 |
| 4,738,287 | 4/1988 | Klinkel . | |
| 4,872,493 | 10/1989 | Everman | 141/67 X |
| 5,259,425 | 11/1993 | Johnson et al. . | |
| 5,316,056 | 5/1994 | Stott | 141/286 X |
| 5,538,162 | 7/1996 | Reh et al. . | |
| 5,598,876 | 2/1997 | Zanini et al. . | |

*Primary Examiner*—David J. Walczak
*Assistant Examiner*—Kathleen J. Prunner
*Attorney, Agent, or Firm*—Henry M. Feiereisen

[57] ABSTRACT

A filling device for discharging bulk material into a container, includes a tube defined by an axis and disposed in sealing engagement with an upper part of a subjacent container. The tube has an inlet receiving bulk material flowing by means of gravity in direction of the axis and an outlet for allowing discharge of bulk material into the container. A gas supply system cooperates with the tube for so feeding gas under pressure into the tube as to change a flow direction of bulk material from a substantially vertical disposition into a substantially horizontal direction when exiting the tube through the outlet.

20 Claims, 5 Drawing Sheets

DEVICE FOR FILLING A CONTAINER WITH FREE-FLOWING BULK MATERIAL

BACKGROUND OF THE INVENTION

The present invention refers to a device for filling a container with free-flowing bulk material, and more specifically to a container filling device for discharging bulk material stored in a silo and moved over a downward path solely by the force of gravity.

Container filling systems on the basis of gravitational forces to move bulk material stored in silos along a downward path into a subjacent container typically include a shut-off valve for regulating a flow of bulk material and a cylindrical pipe or downspout which is formed with an inlet for receiving bulk material from the silo via the valve and an outlet that opens into the container. When gravity is the only force used to move the bulk material from the silo to the top of the container, problems arise in connection with effecting a high filling degree of the container as the bulk material will form an inverted cone within the container as it begins to fill. When the apex of the cone covers the end of the downspout, the filling process is concluded as further bulk material is prevented from flowing through the outlet. Thus, the container exhibits empty spaces in an area around the cone, thereby decreasing the filling degree of the container.

SUMMARY OF THE INVENTION

It is thus an object of the present invention to provide an improved filling device of this type, obviating the aforestated drawbacks.

In particular, it is an object of the present invention to provide an improved filling device by which a container can be charged with bulk material at increased degree of filling.

These objects and others which will become apparent hereinafter are attained in accordance with the present invention by a filling device including a tube projecting into a container in sealing engagement and having an inlet receiving bulk material which flows downwards by force of gravity and an outlet for allowing discharge of bulk material into the container, and a gas supply system for so feeding and conducting gas under pressure into the tube as to change a flow direction of bulk material from a substantially vertical direction into a substantially horizontal direction when exiting the tube through the outlet.

Through the provision of a separate filling device, the discharge of bulk material into a container is de-coupled from the outlet of the downspout, and the incorporation of a gas supply system allows a routing of the flow of bulk material sideways when exiting the filling device and entering the container. Thus, the volume of the container that can be filled with bulk material is greatly increased.

Preferably, the gas supply system includes a gas pressure source, a deflector assembly effecting an even distribution of incoming bulk material toward the outlet and having a hollow body which is securely fixed inside the tube and projects beyond the outlet of the tube, and a baffle plate secured to an underside of the body at formation of a gap between adjacent surfaces of the body and the baffle plate, with the gas supply system further including a passageway system communicating with the pressure source for feeding gas under pressure through the deflector body and the gap, thereby radially deflecting bulk material exiting the tube.

The passageway system may include a ring-shaped manifold circumscribing the tube and connected to the pressure source, and at least one, preferably three or more, gas inlet conduits securely fixed to and projecting into the body and communicating with the ring-shaped manifold.

In order to provide the filling device with a sufficient stability and protection from damage when placed on and in the container, the baffle plate may be formed on its underside with reinforcing ribs extending perpendicular to the longitudinal axis, and the tube may be supported by a bar-type frame assembly.

According to another feature of the present invention, the deflector assembly further includes a hollow cone-shaped member which is secured to the gas inlet conduits and surrounds the hollow deflector body for promoting an even flow distribution of bulk material toward the outlet after bulk material flows past the gas inlet conduits.

Suitably, a vent conduit is disposed laterally of the tube to allow escape of gas under pressure from the container.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
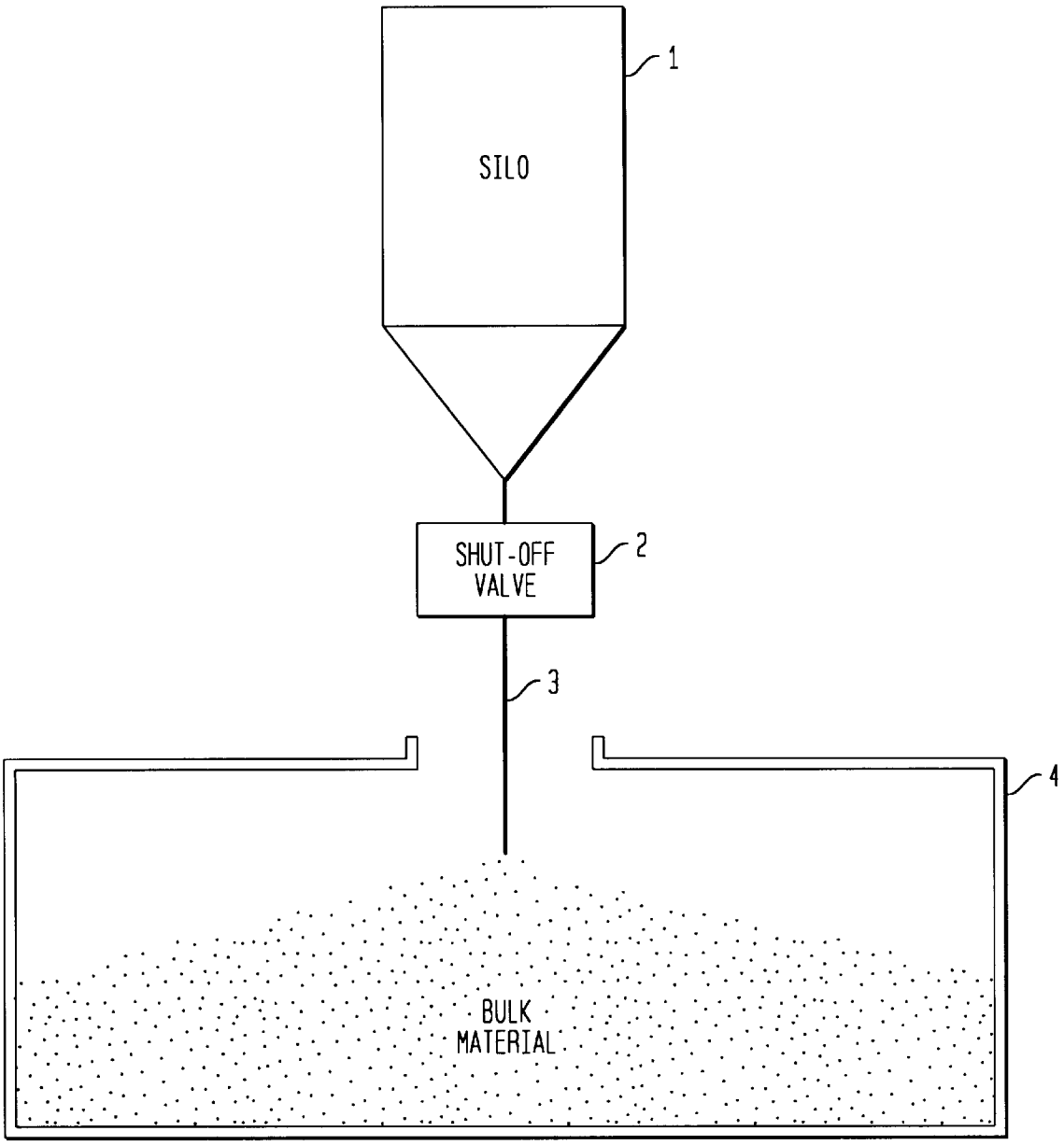
FIG. 1 (PRIOR ART)
FIG. 1 is a schematic illustration of a conventional container filling system.

Throughout all the Figures, the same or corresponding elements are generally indicated by the same reference numerals.

Turning now to the drawing, and in particular to FIG. 1, there is shown a schematic illustration of a conventional system for filling a container 4 with bulk material stored in a silo 1 through use of the force of gravity. Positioned at the bottom of the silo 1 is a control valve 2 such as a shut-off valve or gate valve, which controls a flow of bulk material over a downward path through a pipe, called downspout, 3 into the container 4. When opening the valve 2, bulk material flows by force of gravity from the silo through the downspout 3 into the container 4 such that a cone-shaped distribution profile of bulk material is created, as shown in FIG. 1. The flow of bulk material is stopped as soon as bulk material reaches the outlet mouth of the downspout 3. Thus, as indicated in FIG. 1, the filling capacity of the container 4 cannot be maximized by this conventional system.

Figure 2:
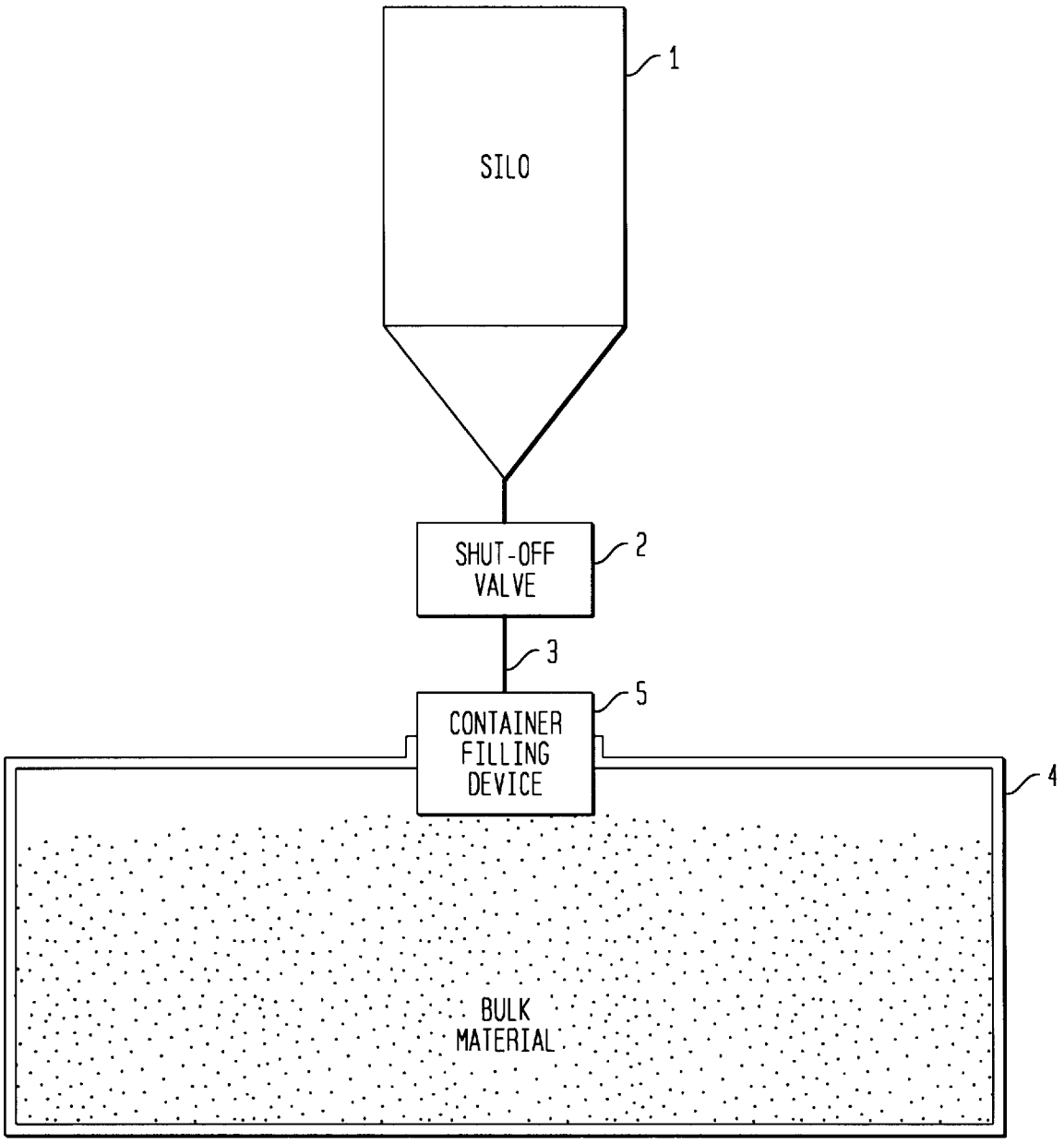
FIG. 2 is a schematic overall illustration of a container filling system in accordance with the present invention.

Turning now to FIG. 2, there is shown a schematic overview of a container filling system according to the present invention. For ease of understanding same reference numerals have been used for same elements as referred to in FIG. 1. The flow of bulk material from the silo 1 is regulated by the control valve 2 for introduction into the downspout 3. Provided at the end of the downspout 3 is a container filling device according to the present invention, generally designated by reference numeral 5. As will be described in more detail hereinafter, the container filling device 5 effects a change of the flow direction of bulk material from a substantially vertical direction to a substantially horizontal direction to thereby attain a significantly increased filling capacity of the container 4, as indicated in FIG. 2 by the distribution profile.

Figure 3:
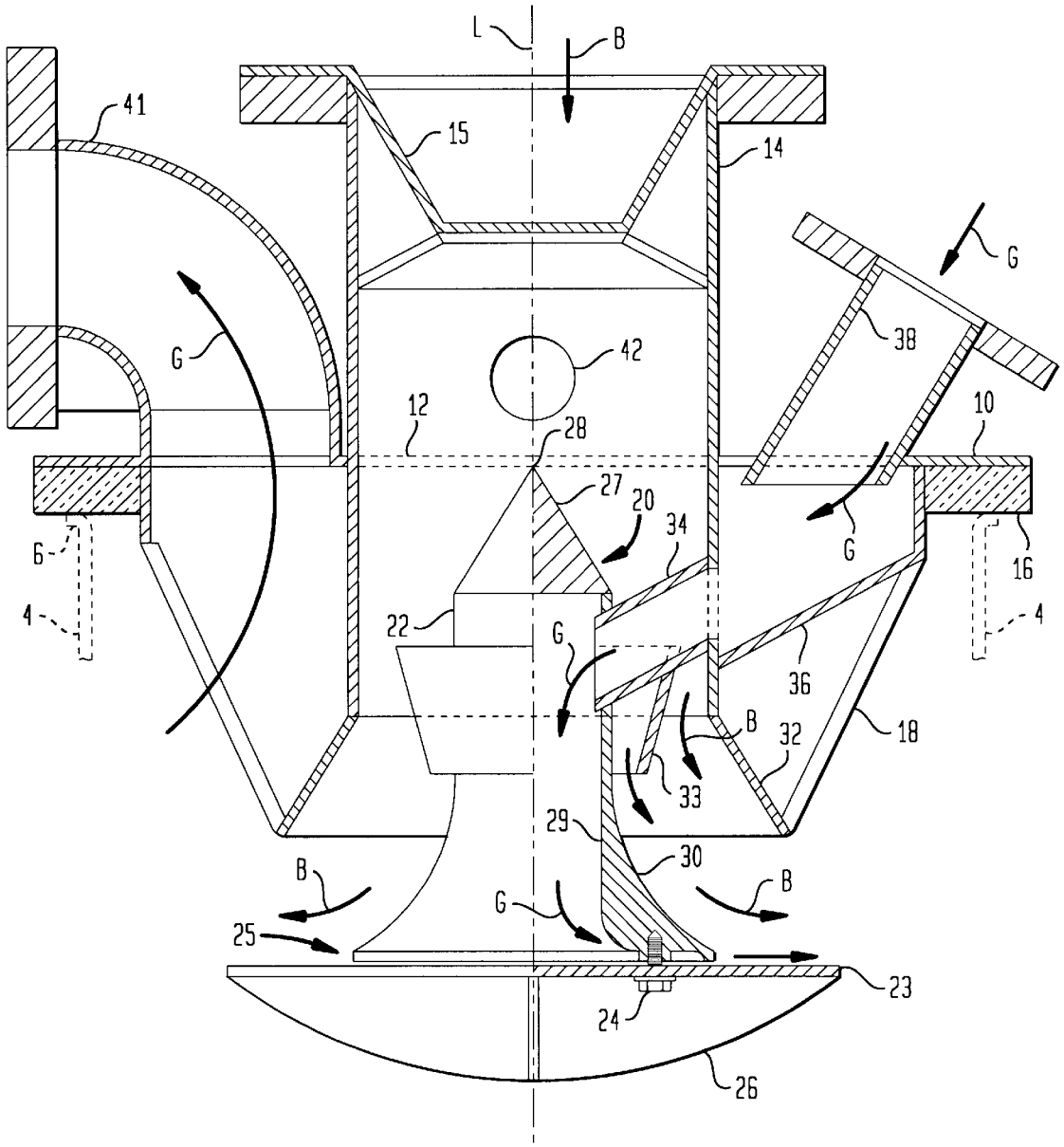
FIG. 3 is a partially sectional view of the container filling device of FIG. 2.

Referring now to FIG. 3, there is shown a partially sectional view of one embodiment of a container filling device 5 in accordance with the present invention. The filling device 5 includes a ring-shaped support plate 10 which is formed with a central opening 12 for receiving a cylindrical tube 14 defining a longitudinal axis L. Formed within the tube 14 at an upper area thereof is a cone-shaped inlet 15 which receives bulk material from the silo 1 via the downspout 3 and deflects bulk material toward a central area of the tube 14. The support plate 10 is formed on the underside with a circumferential seal ring 16 which sits upon a flange 6 of the container 4 to effect a fluid-tight placement of the support plate 10 and thus of the filling device 5 upon the container 4. The tube 14 is suitably reinforced by a frame assembly comprised of bars 18 by which the overall handling and positioning of the filling device 5 is facilitated and risk of damage is reduced.

Mounted within the tube 14 is a deflector assembly, generally designated by reference numeral 20 and including a hollow deflector 22 and a baffle plate 23 so secured by screw fasteners 24 to the deflector 22 that a gap 25 is formed between adjacent surfaces of the baffle plate 23 and the opposing end face of the deflector 22. For further improving the stability of the deflector assembly 20, the baffle plate 23 is formed on the underside with a plurality of arcuated reinforcement ribs 26 that extend perpendicular to the longitudinal axis L of the tube 14.

The deflector 22 is formed with a cone-shaped top 27 having a tip 28 which points upwards toward the inlet 15 and defines an axis that coincides with the longitudinal axis of the tube 14. The deflector 22 is formed with a cylindrical inside wall surface 29 while its outer surface area 30 flares outwards to provide a guidance for bulk material toward the outlet.

At its lower end, the tube 14 is formed integrally with a bottom 32 that flares outwards to demarcate the outlet of the tube 14 and is spaced from the outside surface area 30 of the deflector 22 at a suitable distance to guide the flow of bulk material through the outlet.

Figure 4:
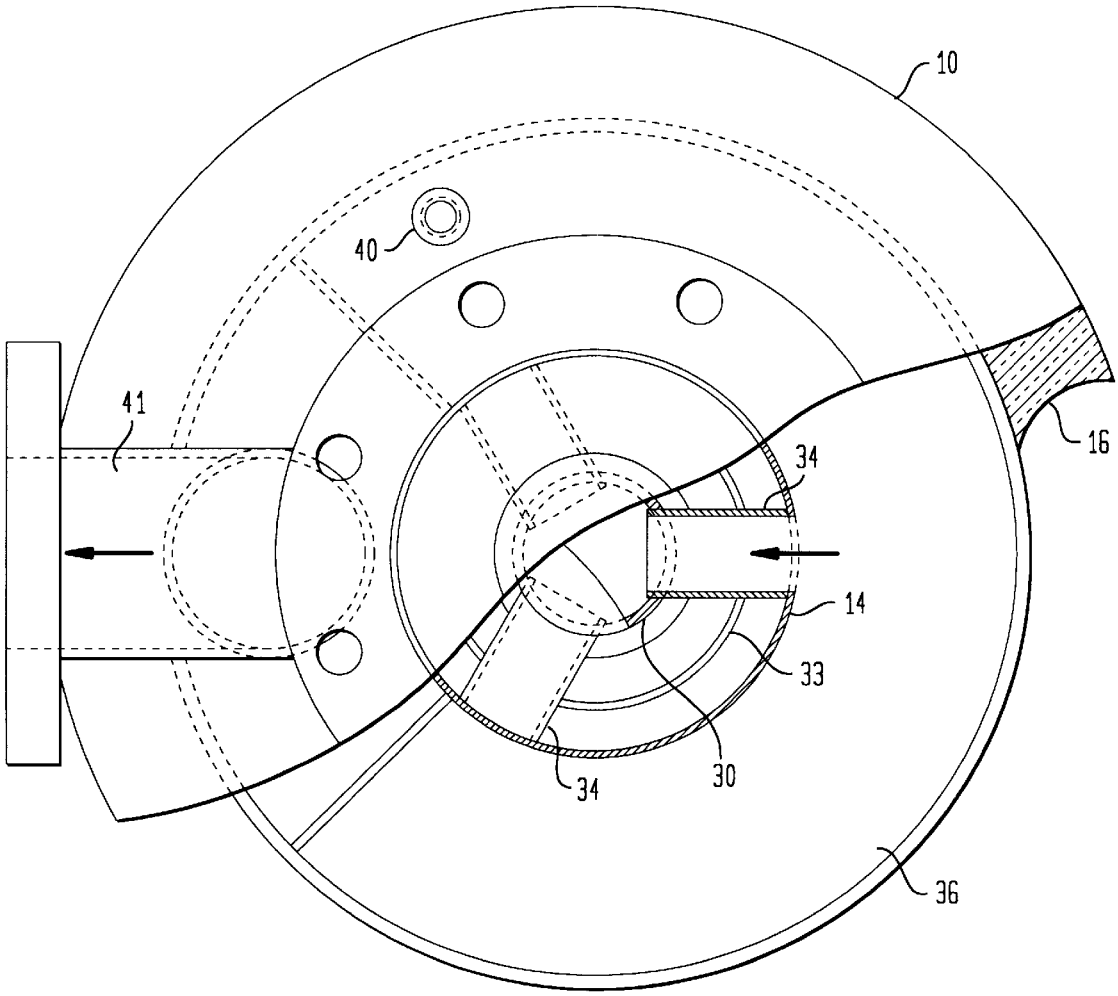
FIG. 4 is a partially cross sectional view of the filling device.
Figure 5:
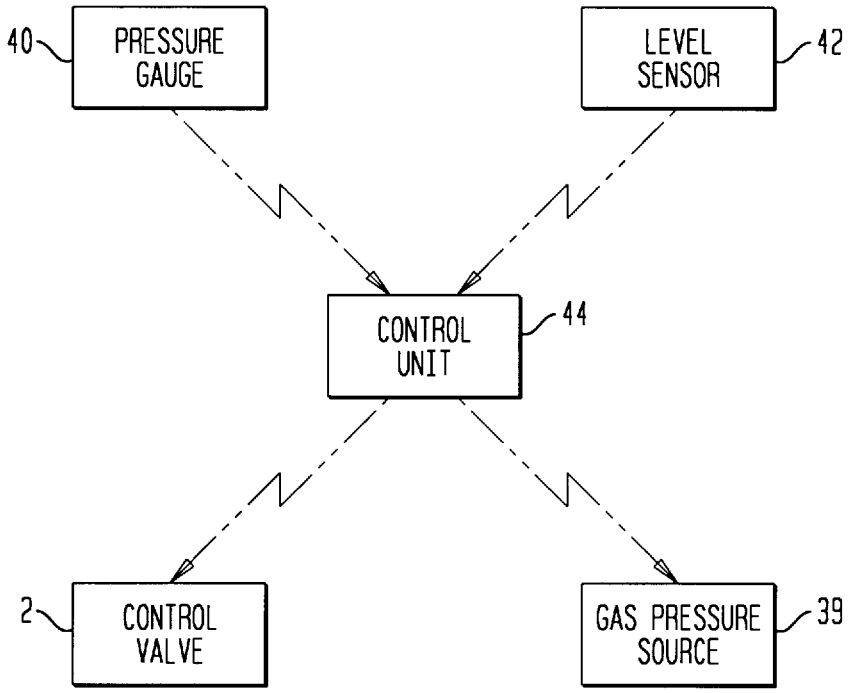
FIG. 5 is a schematic block diagram showing an overview of a control system of the filling device.

The deflector assembly 20 is further provided with a guide cone 33 secured to the deflector 22 in the transition area between the cylindrical section of the tube 14 and the bottom section 32. The guide cone 33 is hollow and tapers inwardly in direction away from the cone-shaped top 27 of the deflector 22. Intersecting the guide cone 33 are three gas inlet conduits 34 which extend from the wall of the tube 14 inwardly at descending incline and project into the interior of the deflector 22. The conduits 34 are in communication with a ring-shaped manifold 36 that circumscribes the tube 14, with the conduits 34 being evenly spaced interiorly about the manifold 36, as shown in FIG. 4. The manifold 36 is connected to an inlet pipe 38 secured in the support plate 10 and communicating with a pressure source 39 (FIG. 5) for supply of gas, such as air, under pressure, with a pressure gauge 40 (FIG. 4) monitoring the gas pressure inside the manifold 36.

Persons skilled in the art will understand that the number of gas inlet conduits 34 should not be limited to three as more or less conduits may be utilized to best suit the respective application.

Suitably, the deflector 22 is welded at the point of contacts to the conduits 34 so as to be retained properly in place. In like manner, the guide cone 33 is welded to the conduits 34 for support.

Positioned laterally of the tube 14 is a vent conduit 41 through which gas is able to exit the interior of the container 4. Suitably, the vent conduit 41 is connected to a filter or dust collector (not shown) for separating environmentally harmful material (e.g. fine and finest bulk material particles) that should not be released into the atmosphere.

At operation, when opening the control valve 2, bulk material is released from the silo 1 to flow downwardly by the force of gravity through the downspout 3 into the filling device 5. While bulk material enters the tube 14 and drops downwards toward the cone-shaped top 27 for even distribution around the deflector 22, as indicated by arrows B, gas under pressure is conducted via inlet pipe 38 and ring-shaped manifold 36 through the conduits 34 into the interior of the deflector 22, as indicated by arrows G. Although the conduits 34 obstruct the downward path of bulk material, the provision of the guide cone 33 promotes an even distribution of bulk material when bulk material flows around the conduits 34 and exits through the outlet. Gas under pressure is deflected radially by the baffle plate 23 to flow via gap 25 in a substantially horizontal direction to thereby force bulk material exiting the outlet of the tube 14 to the perimeter of the container 4. As bulk material fills the container 4, gas escapes through vent conduit 41 for release to the atmosphere, optionally via a filter or dust collector for retaining environmentally harmful products within the system.

Bulk material is filled into the container 4 until covering the baffle plate 23, at which point bulk material accumulates inside the tube 14. As soon as bulk material reaches in the tube 14 a predetermined maximum filling level, a level switch 42 is actuated to instruct a control unit 44 (FIG. 5) to close the control valve 2 and to shut-down the gas supply. The filling process of the container 4 is thus concluded. When withdrawing the filling device 5 from the container 4, bulk material inside the tube 14 is discharged through the outlet into the container 4 to further fill remaining voids.

Persons skilled in the art will understand that the volume of the gas under pressure introduced into the system depends on the size and shape of the container and thus can be suited for optimum results.

While the invention has been illustrated and described as embodied in a device for filling a container with free-flowing bulk material, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A filling device for discharging bulk material into a container, comprising:

a tube projecting into the container and disposed in sealing engagement with an upper part of the container, said tube defined by an axis and having an inlet receiving the bulk material which flows downwards by force of gravity and an outlet for allowing discharge of the bulk material into the container; and gas supply means for so feeding and conducting gas under pressure into the tube as to change a flow direction of the bulk material from a substantially vertical direction into a substantially horizontal direction when exiting the tube through the outlet.

2. The device of claim 1 wherein the gas supply means includes a gas pressure source, a deflector assembly effecting an even distribution of the incoming bulk material toward the outlet, said deflector assembly having a hollow body securely fixed inside the tube and projecting beyond the outlet of the tube, and a baffle plate secured to an underside of the body at formation of a gap between adjacent surfaces of the body and the baffle plate, said gas supply means further including passageway means communicating with the pressure source for feeding the gas under pressure through the body and the gap, thereby radially deflecting the bulk material when exiting the tube.

3. The device of claim 2 wherein the body has a cone-shaped top with a tip facing upwardly toward the inlet.

4. The device of claim 2 wherein the passageway means includes a ring-shaped manifold circumscribing the tube and connected to the pressure source, and at least one gas inlet conduit securely fixed to and projecting into the body and communicating with the ring-shaped manifold.

5. The device of claim 4 wherein the gas inlet conduit extends at a downward incline.

6. The device of claim 4 wherein the gas supply means includes three such gas inlet conduits evenly spaced from one another about the ring-shaped manifold.

7. The device of claim 4 wherein the deflector assembly includes a hollow cone-shaped member secured to the conduit and surrounding the body for promoting an even flow of bulk material toward the outlet.

8. The device of claim 4, and further comprising a pressure gauge operatively connected to the ring-shaped manifold for monitoring the pressure of the gas.

9. The device of claim 2 wherein the baffle plate has an underside formed with reinforcing ribs extending perpendicular to the axis.

10. The device of claim 1 wherein the tube is formed with a bottom flaring outwardly to guide the bulk material toward the outlet.

11. The device of claim 1, and further comprising a frame for supporting the tube inside the container.

12. The device of claim 1, and further comprising a sensor secured to the tube for determining a maximum filling level of the bulk material within the tube.

13. The device of claim 1, and further comprising a vent conduit disposed laterally of the tube to allow escape of the gas under pressure from the container.

14. A filling device for discharging bulk material into a container, comprising a tube projecting in fluid-tight manner into the container, said tube having an inlet and an outlet and forming a first passageway for directing the bulk material over a downward path toward the outlet, and pneumatic means for so feeding gas under pressure through a second passageway as to change the flow direction of the bulk material from a vertical direction into a substantially horizontal direction when exiting the outlet and being discharged into the container.

15. The filling device of claim 14 wherein the pneumatic means includes a pressure source and a hollow body secured within the tube and communicating with the pressure source, said hollow body being so configured as to allow exit of the gas under pressure into the first passageway in a radial direction in immediate proximity of the outlet.

16. The filling device of claim 15 wherein the hollow body has a baffle plate so secured to a lower end face of the hollow body that a gap is formed between adjacent surfaces of the hollow body and the baffle plate and communicates with the first passageway.

17. The filling device of claim 16 wherein the hollow body is disposed in a central area of the tube, said pneumatic means including at least one conduit connected to the pressure source and extending from a wall of the tube into the hollow body.

18. An arrangement for discharging bulk material from a silo into a container, comprising:

a control valve for regulating a flow of the bulk material from the silo;

a pipe for conducting the bulk material by force of gravity over a downward path, said pipe having an inlet end connected to the control valve, and an outlet end; and a filling device connected to the outlet end of the pipe and projecting into the container in sealing engagement with an upper part of the container, said filling device having a first passageway for directing the bulk material over a downward path toward an outlet, a second passageway, and pneumatic means for so feeding gas under pressure through the second passageway as to change the flow direction of the bulk material from a vertical direction into a substantially horizontal direction when exiting the outlet and being discharged into the container.

19. The arrangement of claim 18 wherein the filling device includes a cylindrical tube for forming the first passageway, and a deflector secured within the tube and defining an interior space, said pneumatic means including a pressure source communicating with the interior space of the deflector for forming the second passageway.

20. The filling device of claim 19 wherein the deflector has a baffle plate so secured to a lower end face of the deflector that a gap is formed between adjacent surfaces of the deflector and the baffle plate and communicates with the first passageway.

* * * * *